US005249556A

United States Patent [19]

Emmitt

[11] Patent Number: 5,249,556

[45] Date of Patent: Oct. 5, 1993

[54] ADJUSTABLE LUBRICATING SYSTEM

[76] Inventor: William J. Emmitt, P.O. Box 31, Delphi, Ind. 46923

[21] Appl. No.: 666,697

[22] Filed: Mar. 8, 1991

[51] Int. Cl.[5] ..... F01M 1/16

[52] U.S. Cl. ..... 123/196 S; 123/196 CP; 184/6.4

[58] Field of Search ..... 123/196 R, 196 CP, 196 S; 184/108, 6.4

[56] References Cited

U.S. PATENT DOCUMENTS

| | | | |
|---|---|---|---|
| 1,948,479 | 2/1934 | Caminez | 184/6.4 |
| 2,111,242 | 3/1938 | Harley | 184/6 |
| 2,138,969 | 12/1938 | Hobbs | 184/6.4 |
| 2,213,147 | 8/1940 | Parkins et al. | 123/196 R |
| 2,298,646 | 10/1942 | Ovens | 184/6.4 |
| 4,709,671 | 12/1987 | Sumigawa | 123/196 S |

FOREIGN PATENT DOCUMENTS

| | | | |
|---|---|---|---|
| 2629730 | 1/1978 | Fed. Rep. of Germany | 123/196 CP |

OTHER PUBLICATIONS

Darlington, Harley-Davidson Electraglide & Super Glide Owners Manual; pp. 88-90, Haynes Publ.

Harley-Davidson Motor Co., Instructions—Oil Pump Kit, pp. 1-3, rev. Nov. 1984.

*Primary Examiner*—E. Rollins Cross
*Assistant Examiner*—Erick Solis
*Attorney, Agent, or Firm*—Lundy & Associates

[57] ABSTRACT

An adjustable lubricating system for an internal combustion engine such as the Harley-Davidson 74 and 80 cubic inch twin-v engines. An oil pump having a pressure relief valve connected to a plurality of passages adjacent the pump outlet through which pressurized oil flows to lubricate various parts depending upon the positioning of the valve. A pressure relief cap is provided with a bore extending therethrough in which an adjusting screw is positioned. The cap, bore and screw have mating threads allowing the screw to be movably positioned within the bore. The cap has external threads thereon mating with the internal threads of the pressure relief valve bore of the fuel pump of the lubricating system of the engine. An oil seal is provided within the cap bore which engages the screw. The screw engages the pressure relief spring of the pressure relief valve. The spring is positioned between the screw and the valve plunger whereby the distribution of oil to the engine parts to be lubricated is determined by adjusting the position of the screw in the cap bore.

18 Claims, 5 Drawing Sheets

ADJUSTABLE LUBRICATING SYSTEM

BACKGROUND OF THE INVENTION

1. Field of Invention

This invention relates to an improvement in oil pumps for internal combustion engines, and more particularly, to an improvement in oil pumps for HARLEY-DAVIDSON 74 and 80 cubic inch twin-v-engines.

2. Description of Related Art

Low oil pressure is a common problem in HARLEY-DAVIDSON 74 and 80 cubic inch twin-v-engines, using the aluminum bodied, rotary gear oil pump. This design of oil pump. U.S. Pat. No. 2,111,242 Harley, utilizes a pressure relief valve to control the oil pressure that is supplied to the engines. This design of said oil pump is used on all HARLEY-DAVIDSON 74 and 80 cubic inch twin-v-engines.

Referring now to U.S. Pat. No. 3,912,045 Morris, which describes a different design of oil pump rather than the rotary gear, pressure relief type. The said patent goes into detail of how the pressure relief spring controls the oil pressure from the relief valve in a rotary gear type pump.

Briefly, in accordance with U.S. patent application No. 07/645,620 Emmitt, said patent application uses a pressure relief spring of different lengths to increase the biasing means between the pressure relief plunger and the pressure relief cap. With the said spring being the biasing force that holds the said plunger closed until sufficient pressure is obtained that will lift the said plunger, opening an oil passage, thus controlling the oil pressure of the HARLEY-DAVIDSON aluminum bodied, rotary gear oil pump. By increasing the biasing means, the biasing force upon said plunger is increased, which increases the oil pressure.

Although, the motorcycle industry or aftermarket companies have introduced oil pumps of the said design, with a few changes, they are quite expensive and still do not address the problem of low pressure.

It is the purpose of this invention to provide a lubricating system which dramatically improves and precisely meters the oil in the HARLEY-DAVIDSON 74 and 80 cubic inch twin-v-engine, while still utilizing the stock HARLEY-DAVIDSON oil pump.

No device is known, however, that effectively improves and precisely meters oil in the stock and stock style of the HARLEY-DAVIDSON oil pump.

SUMMARY OF INVENTION

The principal object of the invention is to provide a lubricating system that is effective in raising the oil in the HARLEY-DAVIDSON 74 and 80 cubic inch engines.

It is also an object of the present invention to provide such a device that precisely meters the oil pressure that is supplied to the HARLEY-DAVIDSON 74 and 80 cubic inch engines when used with a stock oil pump.

Another object is to provide such a device which, in use, can be used to quickly and easily adjust oil to fit the needs of each engine in use, while retaining the stock oil pump.

A further object is to simplify the removal and installation of such a device.

With the latter of the objects to provide a device that, in use, restricts the loss of pressure and the leakage of oil.

The foregoing objects can be accomplished by providing an improved design of pressure relief cap that incorporates an adjusting screw which can be utilized with a stock oil pump on a Harley-Davidson 74 and 80 cubic inch engine.

DESCRIPTION OF THE DRAWINGS

The features of the invention which are believed to be novel are set forth with particularity in the appended claims. The invention itself, however, both of its organization and operation, together with further objects and advantages there of, may best be understood by reference to the following description taken in connection with the accompanying drawings in which:

FIG. 10 is an elevation of the engine with parts broken away in vertical section exposing the crank shaft, the rotary trap valve, and the separating chamber, the crank shaft and the crank being partially broken away to expose the lubricating duct therein.

FIG. 11 is a view, partly in plan and partly in horizontal section exposing the fly wheels and the relation to the elevated sump and trap valve, a fragment of the crank shaft being also shown in horizontal section.

FIG. 12 is a fragmentary view in horizontal section showing the separating chamber, a fragment of the pump assembly in association therewith and the vent duct and nozzle in association with a fragment of the chain.

FIG. 13 is a detailed perspective view of the trap valve.

FIG. 14 is a view taken at right angles to FIG. 10, with a portion of the wall of the gear case broken away.

FIG. 15 is a view of the crank case and gear assembly, partially in elevation and partially in vertical section, drawn generally to line 6—6 of FIG. 10.

FIG. 16 is a detailed view showing the pump supporting portion of the gear case with the pump removed, and part of the gear case cap in section.

FIG. 17 is a fragmentary view of the right hand side of the parts illustrated in FIG. 16 with portions broken away in vertical section.

FIG. 18 is a fragmentary view of the intake and exhaust valve assembly partially in elevation and partially in section, drawn to a plane through one of the rocker arms and the spring housing of one of the valves.

FIG. 19 is a vertical sectional view of the feed pump and associated valves.

FIG. 20 is an elevation of the scavenging pump, partially broken away to expose the needle valve controlling the supply of liquid lubricant to the chain lubricating nozzle.

FIG. 21 is a view of the feed and scavenging pump assembly in horizontal section.

FIG. 22 is a sectional view of the sump taken along line 13—13 of FIG. 11.

DETAILED DESCRIPTION

Figure 1:
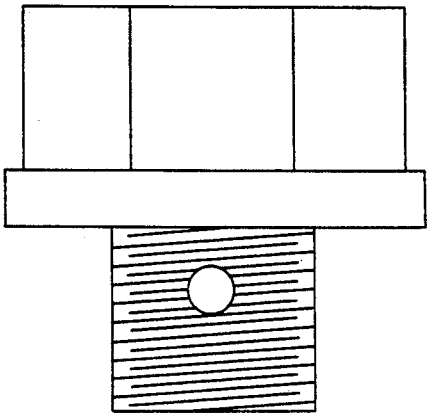
FIG. 1 is a front plan view of the adjustable cap of the invention.

Referring now to FIG. 1, which is a front view of the preferred adjustable pressure relief cap. The preferred design of the adjustable pressure relief cap comprises of two seperate devices: the cap 1 and an adjusting screw 2. The two said devices increase and precisely meter the oil in the HARLEY-DAVIDSON 74 and 80 cubic inch twin-v-engines, when used in conjunction with an oil pressure gauge. The said oil pressure gauge is only used to measure the oil pressure of the said engine.

Figure 2:
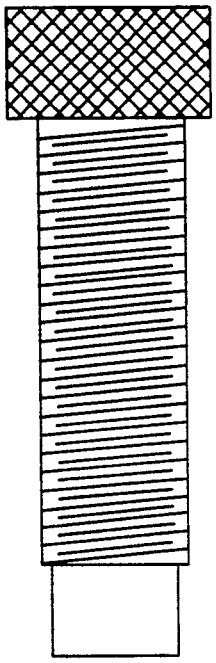
FIG. 2 is a front plan view of the adjusting screw of the invention.

Referring now to FIG. 2, which is a front view of the preferred adjustable pressure relief cap 1 only. The said cap 1 is preferably made of aluminum. The overall length 3 is 0.875"±0.015". The upper section 4 of said cap 1 having a height of 0.500"±0.010". The top of the said cap, which is of hexagon design, having a height 5 of 0.375"±0.005". The mating surface of said cap 1 having a height 6 of 0.125"±0.005".

The preferred shank 7 of said cap 1, having a length 8 of 0.375"±0.005". The shank itself has a diameter 9 of 0.500"±0.005", which is also preferably threaded to a common external, right handed, twenty threads per inch. This enables the said cap 1, to be assembled to the stock HARLEY-DAVIDSON oil pump. Also shown is a hole 10, having a diameter of 0.125"±0.005". The said hole 10 being centered in said shank 7, located 0.3125"±0.005" from the bottom edge of said shank 7 and to be completely drilled through said shank 7. The said hole 10, when used in conjunction with an in an internal slot 11, which is described later, forms an oil gallery. The said gallery, is used to supply oil to the primary and/or secondary chain on the Harley-Davidson motorcycles so equipped. The location of said hole 10, is critical, as a gasket with a thickness of 0.060" is assembled between the said cap and the stock oil pump to form a seal, preventing oil loss. Therefore, if the location of said hole 10 is not correct, the oil flow through said gallery will be restricted or completely blocked.

On models of the HARLEY-DAVIDSON motorcycle that use a belt drive primary and/or secondary instead of chains, the said cap 1 will not include the said hole 10 or the previously mentioned internal slot 11. As the belt drive system requires no lubrication.

Figure 3:
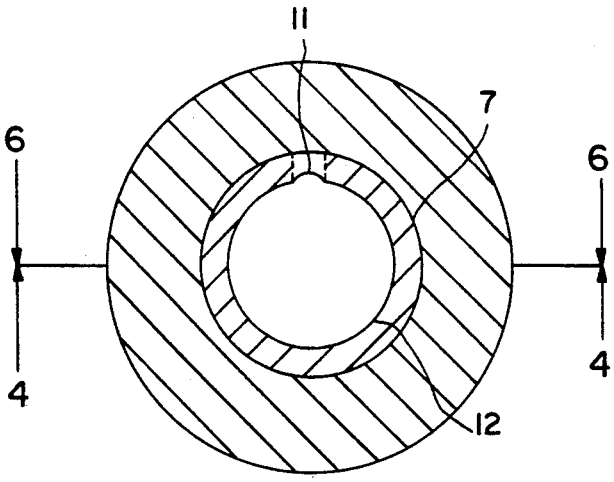
FIG. 3 is a bottom plan view of the adjustable cap of the invention.

Referring now to FIG. 3, which is a bottom view of the preferred cap 1. Centered in said cap 1, is an internal bore 12 with a preferred diameter of 0.355"±0.005", which allows the pressure relief spring to fit inside of the shank 7 of the adjustable pressure relief cap 1. The previously stated internal slot 11, having the preferred specifications of a radius of 0.062"±0.005" being bored 0.035"±0.005" deep into the internal wall of the said shank 7. The said slot 11 to be centered in the internal bore of the shank 7 of the preferred cap 1. With the said slot 11 being located directly in line with the said hole 10. The said slot 11 to be bored to a depth of 0.3125"±0.005". This will center said slot 11 into said hole 10 to form the previously stated oil gallery.

Figure 4:
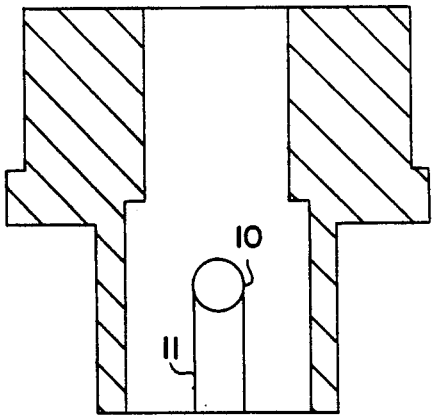
FIG. 4 is a cross-sectional view of the adjustable cap of the invention taken substantially along the section line 4—4 of FIG. 3.

Referring now to FIG. 4, which is a cutaway front view of the preferred cap 1 in which the said oil gallery, comprising of the previously stated slot 11 and hole 10 are shown in more detail.

Figure 5:
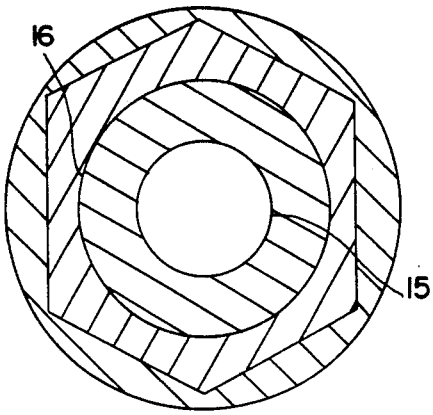
FIG. 5 is a top plan view of the adjustable cap of the invention showing the preferred location of the oil seal.

Referring now to FIG. 5, which is a top view of the preferred cap 1. The hexagon design, having a preferred distance 13 of 0.745"±0.005" across any two parallel flats. The hexagon design, being an improved design of the stock pressure relief cap, that simplifies the installation and removal of the adjustable pressure relief cap 1. With the mating surface 14 having the preferred diameter of 0.940"±0.005". Centered in said head design is an internal bore 15 that is preferably drilled and tapped to a common right hand, internal 5/16"×24 threads per inch. The said internal bore 15 being threaded to accept the preferred adjusting screw 2. Also shown is the preferred location of an oil seal 16 being either of single or double lipped design, used to seal around the said adjusting screw 2 to help prevent the loss of oil and oil pressure.

Figure 6:
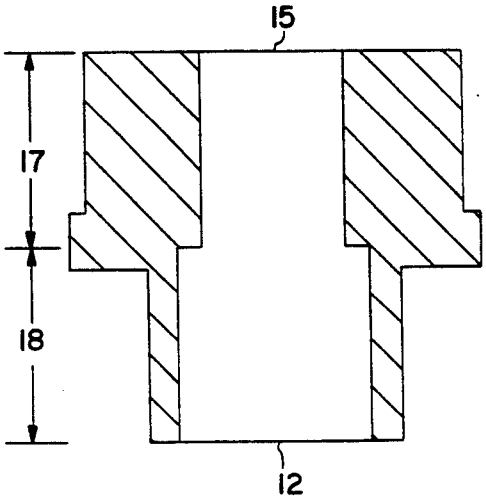
FIG. 6 is a cross-sectional view of the adjustable cap of the invention taken substantially along the section line 6—6 of FIG. 3.

Referring now to FIG. 6, which is a cutaway front view of the preferred adjustable pressure relief cap 1. The said cap comprises of two internal bores, both being centered in said cap 1, with one of the previously stated internal bores 15 being threaded to accept the preferred adjusting screw 2 and having a preferred depth 17 of 0.438"±0.005". The internal bore 12 that is not threaded comprises of the following preferred specifications of a depth 18 of 0.437"±0.005" and a previously stated diameter of 0.355"±0.005". The said internal bore 12 allows the pressure relief spring to fit inside of the shank 7 of the adjustable pressure relief cap 1, forming the original biasing means between the said spring and the pressure relief plunger.

Figure 7:
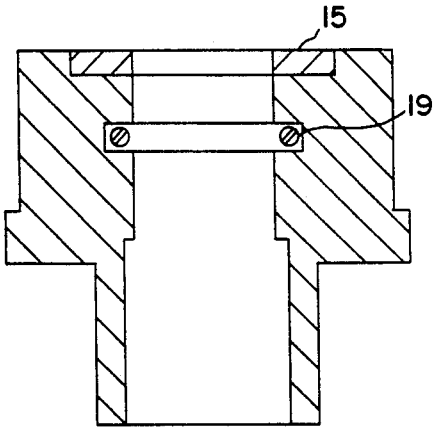
FIG. 7 is a cross-sectional view similar to FIG. 6 of the adjustable cap of the invention showing the preferred locations of an oil seal and an oil ring in more detail.

Referring now to FIG. 7, which is a cutaway front view of the preferred adjustable pressure relief cap 1, showing the locations of the previously stated oil seal 15, being of single or double lipped design and an o-ring 19, both of common design, to seal around the adjusting screw 2, preventing the loss of oil and oil pressure.

The preferred locations and specifications of the said seal 15 comprises of being located in the top hexagon design of the said cap 1, being centered and counterbored to a depth that allows said seal 15 to fit "flush" or even within said hexagon design.

The preferred location and specifications of said o-ring 19, comprises of having a depth of 0.219"±0.005" into the previously stated internally threaded bore 15 and being concentric to and centered inside of the said bore, with the top of the hexagon design of said cap 1, used as the point of reference for the said depth.

Figure 8:
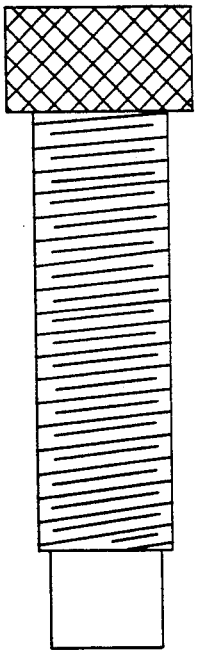
FIG. 8 is a front plan view of the adjusting screw of the invention illustrated in FIG. 9 separated from the adjustable cap of the invention.

Referring now to FIG. 8, which is a front view of the preferred adjusting screw 2. The preferred material being steel and comprises of the following preferred specifications. The overall length 20 of said screw 2 being 1.500"±0.010". The cap 21 of the said screw 2 having a length 22 of 0.250"±0.005" and a diameter 23 of 0.375"±0.005". With the cap 21 of the said screw 2 having a knurl or course design to enable the easy adjustment of said screw 2 into said cap 1. The shank length 24 of said screw 2 being 1.250"±0.005" and having and outside diameter 25 of 0.3125"±0.005", being preferably threaded to a common right hand 24 threads per inch. With the bottom portion of said screw 2 having a length 26 of 0.250"±0.005" and a smaller diameter 27 of 0.230"±0.005" allowing said diameter 27 to fit inside of the pressure relief spring.

Figure 9:
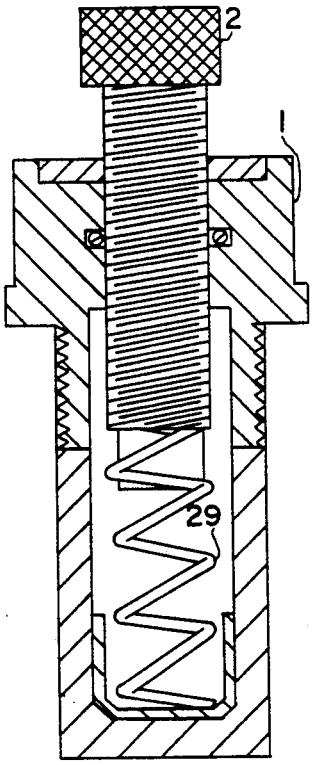
FIG. 9 is a fragmentary cross-sectional view showing the adjustable cap of the invention similarly to FIG. 6 assembled with the adjusting screw, the pressure relief spring, and the pressure relief plunger in the stock HARLEY-DAVIDSON oil pump.
Figure 11:
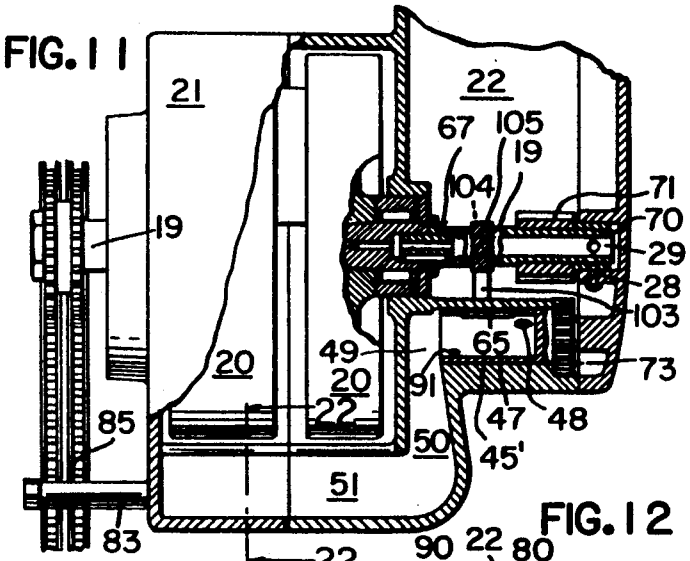
FIGS. 10–22 disclose the Harley-Davidson twin-v 74 and 80 cubic inch engines in combination with its rotary gear oil pump detailing the lubrication system therefore which is prior art to this invention.

Referring now to FIG. 9, which is a cutaway front view of the preferred adjustable cap 1 and the adjusting screw 2 being assembled together and into the pressure relief body 28 of the Harley-Davidson aluminum bodied oil pump. Also shown is the pressure relief spring 29 and the pressure relief plunger 30. By turning the preferred adjusting screw 2 clockwise, the biasing means between the said plunger 30 and said spring 29 will be increased. The said spring 29 being a biasing force that holds the said plunger 30 closed until a sufficient amount of pressure is obtained that will lift the plunger 30 opening an oil passage, thus controlling the oil pressure of said pump. By increasing the biasing force of said spring 29 of the said pump, the oil pressure will be increased. In relation, when said screw 2 is turned counter-clockwise, the biasing means of said screw 2 will be decreased. Which will decrease the biasing force of said spring 29 and lower the oil pressure of the said pump. Thus, the adjusting screw 2 when used in conjunction with the adjustable pressure relief cap 1, forms an adjustable biasing means between the said spring 29 and said plunger 30 enabling the easy adjustment and precise metering of oil pressure of the HARLEY-DAVIDSON aluminum bodied, rotary geared oil pump.

Figure 10:
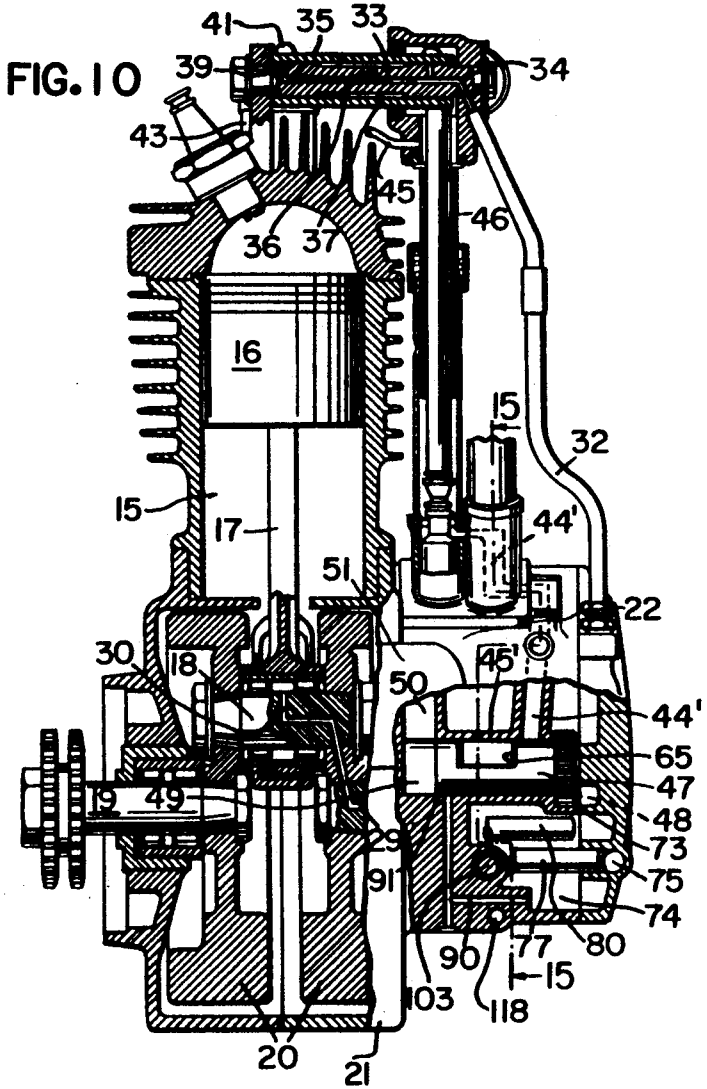
Figure 22:
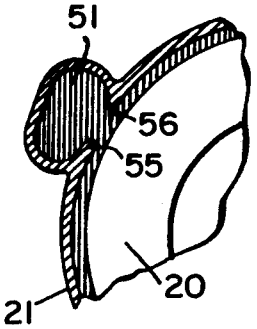

FIGS. 10–22 illustrate a motorcycle engine in which cylinders 15 (FIGS. 10 and 14), with their pistons 16 connecting rods 17, cranks 18, crank shaft 19, fly wheels 20, together with the crank case 21, gear case 22 and associated timing gears, cam shaft, tappet rods, and the rocker arm and valve assembly may all be assumed to be of ordinary construction, except as modified to adapt them to my improved lubricating system as hereinafter described.

Figure 12:
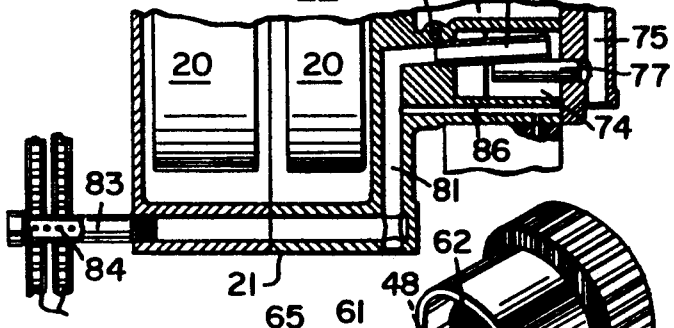

The lubricant is stored in a suitable tank or reservoir 25 (FIG. 14), from which it is withdrawn through a pipe 26 by means of a pump 27 (FIGS. 14 and 21), which delivers it to a duct 28, crank shaft duct 29 (FIG. 13), and branch duct 30 in the crank 18 (FIG. 12). The main bearings of the crank shaft 19 may receive splashed lubricant from the crank case.

Figure 18:
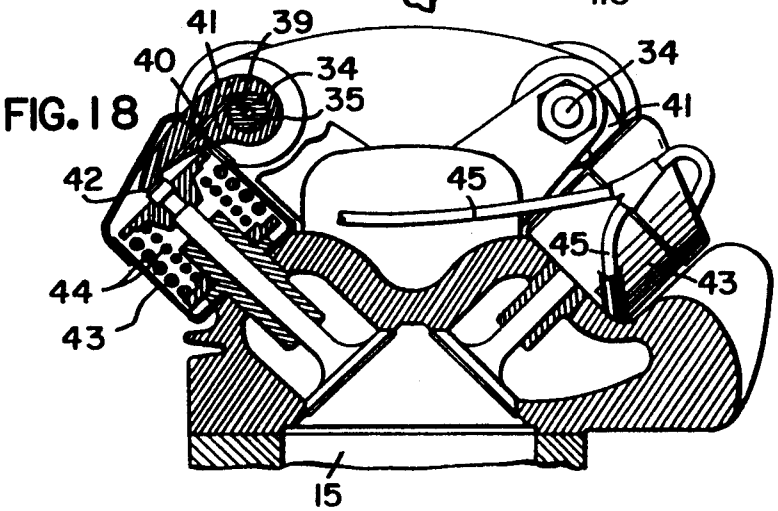

From the pump, lubricant is also delivered upwardly through a duct 32 to an axial duct 33 in the fixed shaft 34 upon which the rocker arm sleeve 35 is journaled. A radial branch duct 36 delivers the lubricant to an annular cavity 37 encircling the central portion of said fixed shaft 34. Branch ducts 39 lead through the end portions of sleeve 35 and communicate with ducts 40 in the respective rocker arms 41 (FIG. 18). These ducts deliver lubricant to the tappet bearings 42, and the excess lubricant enters the cups 43 which house the valve springs 44.

Figure 13:
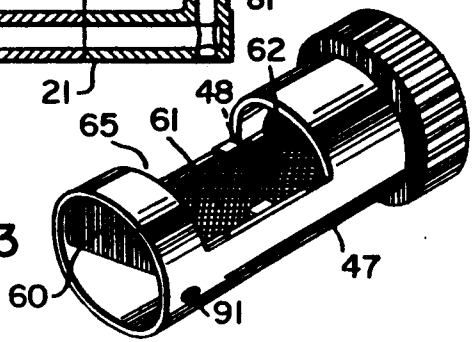
Figure 15:
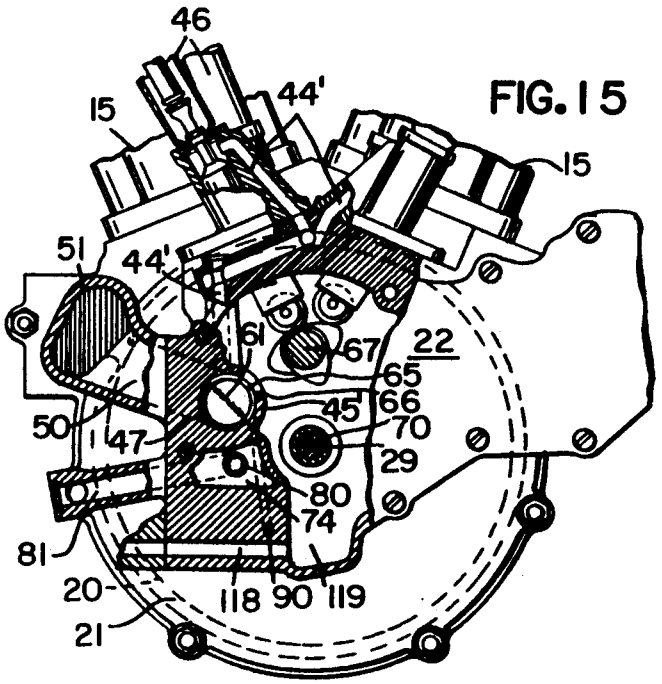

The lubricant drains from these cups 43, preferably through ducts 45 which lead to the tappet rod housing tubes 46 (FIG. 12), or other suitable conduits connected by a duct 44 with the casing 45 of a rotary cylindrical trap valve 47 (FIGS. 12, 13, and 15). Delivery from the duct 44 to the interior of the trap valve 47 is accomplished once during each revolution of the trap valve when its port 48 is brought in registry with the outlet of duct 44, where it enters the trap valve case 45.

The rotary trap valve 47 has an open end in communication with the crank case through a cavity 49 at the inner end of the trap valve casing 45 and through a duct 50 connected with an elevated sump 51 (FIGS. 12, 13, 14, and 15). This sump 51 is located in a lateral extension of the side wall of the crank case and is in communication with the upper portion of the crank case on the side along which the crank ascends. During the operation of the engine, lubricant is swept upwardly from the bottom portion of the crank case 21 by the fly wheels 20 and thrown by centrifugal force into the sump over the arcuate wall 55 interposed between the bottom portion of the sump and the crank case cavity. This lubricant is delivered downwardly through the duct 50 to the end portion 49 of the trap valve casing 45 and is blown into the trap valve during periods of compression in the crank case. Preferably the wall 55 recedes slightly from the fly wheel, and the overhanging wall 56 has a finished or knife edge in close proximity to the fly wheel to scrape drops of oil from its periphery.

Figure 14:
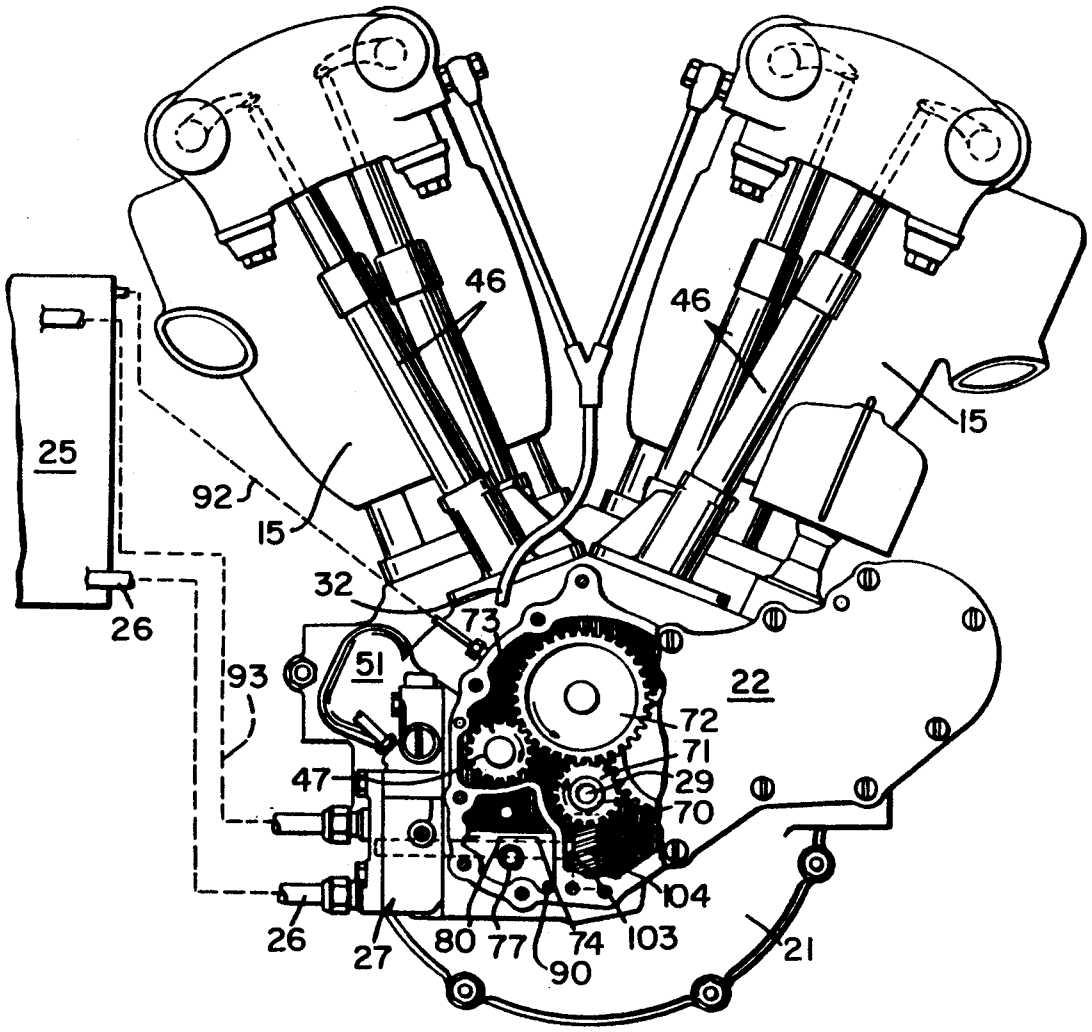

The open inner end of the trap valve 47 is partially closed by a wall 60 (FIG. 13), and a screen 61 extends from this wall to a corresponding wall 62 near the opposite end of the valve, said screen extending over a large outlet port 65 formed by cutting away substantially one-half of the wall of the valve on the outlet side of the central portion of the screen 61. During each revolution of the valve this port 65 is brought into registry with a port 66 in the valve casing, which permits an oblique upward delivery of such lubricant as is blown through the screen 61, including both liquid and vaporized lubricant. As shown in FIG. 15, this lubricant is delivered to the cam shaft 67 and associated parts in the gear housing, and it is sufficiently distributed throughout the gear housing to provide adequate lubrication to the gears. As shown in FIG. 14, motion is transmitted from the crank shaft extension 70 to the rotary valve 47 through the pinion 71, gear wheel 72, and the pinion 73 on the outer end of the trap valve 47. Gear wheel 72 is secured to the cam shaft 67.

Air and vaporized lubricant is delivered from the gear chamber downwardly into the separating chamber 74 through an oblique duct 75, preferably formed in the gear chamber cap 22, with its lower end in communication with the horizontally disposed pipe 77 extending into the separating chamber. This delivery occurs when the trap valve 47 places the gear chamber in communication with the crank chamber during compression periods. The trap valve being actuated from the driving cam shaft gear 72, the registry of the trap valve main outlet with the port 65 will be properly timed. There being two compression periods for each revolution of the cam shaft, the pinion 73 is made one-half the diameter of the gear wheel 72.

The air with its entrained oil and vapor which passes downwardly through the duct 75 into the separating chamber is blown through the nozzle pipe 77 against the opposite wall of the chamber (FIG. 12), and a portion of the liquid lubricant, including vapor which condenses on said wall, is separated and drops to the floor of the separating chamber. The remainder returns to the cap wall for further condensation and the residue enters the outlet pipe 80 which delivers it to a duct 81 in the crank case wall which leads to a laterally projecting nozzle 83 having small distributing ports 84 for jet delivery to the power transmitting chain 85. In a motorcycle, this chain drives the traction wheel.

If the supply of lubricant for chain 85 should be deficient, added lubricant may be delivered to the duct 81 through a duct 86, the inlet end of which is connected with a return circulation or scavenging pump 87 hereinafter described. An adjustable throttle valve, referably a needle valve 88, controls delivery from the pressure side of the pump 87 to the duct 86.

Liquid lubricant settling to the bottom of the separating chamber may be returned to the trap valve through the duct 90 and valve port 91 during suction periods when the engine pistons are ascending and the pressure in the crank case is below atmospheric. During the same period, but not necessarily at the same time, valve port 48 registers with duct 44 and extends the suction to the cups 43. At such times the main outlet port 65 of the rotary trap valve 47 is closed.

Figure 20:
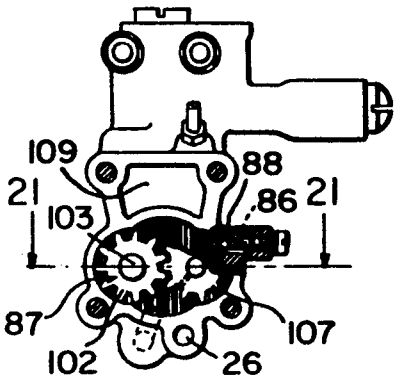
Figure 16:
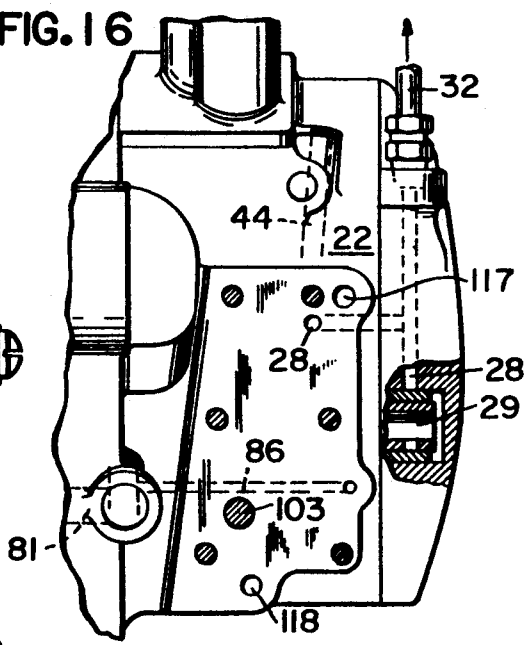

Excess liquid lubricant accumulating in the bottom of the gear case is drawn off by means of the return circulation or scavenging pump shown in FIG. 20 and returned to the reservoir 25 through the pipe 93. The upper portion of the reservoir 25 is preferably in communication with the gear case through a vent pipe 92, whereby the pressure in the reservoir and gear case may be equalized.

Figure 21:
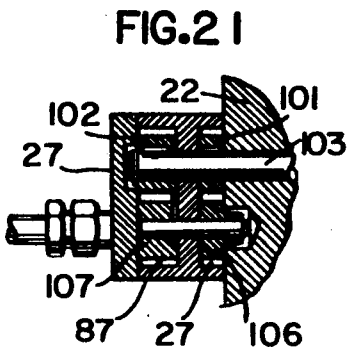
Figure 19:
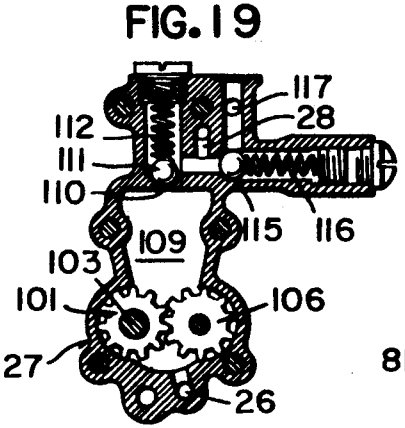

The pump assembly is best illustrated in FIGS. 19, 20, and 21.

Rotary gear pumps are preferably employed for both the force feed and return side of the circulatory system. The force feed pump 27 (FIG. 19) and return circulation pump 87 (FIG. 20) have their respective driving gears 101 and 102 mounted on a shaft 103 (FIG. 21), which has a beveled spiral gear 104 in mesh with a spiral pinion 105 (FIG. 11) fixed to the crank shaft extension 70. The pump gears 106 and 107 of the pumps are driven from the gears 101 and 102, respectively.

Figure 17:
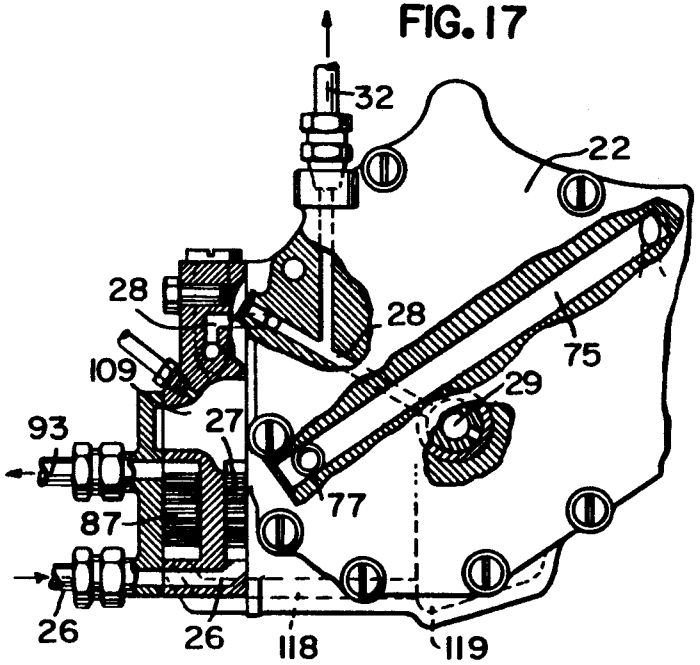

Feed pump 27 has a priming chamber 109 (FIG. 19). Its outlet port 110 is normally closed by a ball valve 111, urged to its seat by a spring 112 and the pressure of the oil above it. From the outlet side of this valve, the lubricant is delivered through duct 28 to the crank shaft, and through branch duct 32 to the rocker arms. Excess lubricant, if sufficient to develop pressure enough to open valve 115 against the resistance of spring 116, will be by-passed to the gear chamber through duct 117 and returned to the reservoir through duct 118, pump 87, and the duct 93 which leads to the reservoir, (FIGS. 14 and 17). Duct 118 is in communication with a gear chamber sump 119 (FIG. 15).

From the foregoing description it will be apparent that an adequate supply of lubricant can be delivered by the feed pump to all parts of the engine subject to wear, final distribution to the gear chamber and to the chain during periods of compression in the crank case being governed by the trap valve 47, which during suction periods, also aids in withdrawing excess lubricant from the rocker arm assembly and the separating chamber 74. All excess lubricant accumulates in the gear case sump 119 and is returned to the reservoir by the pump 87.

It will be understood that the rotary trap valve receives lubricant from the sump during periods of compression in the crank case. During periods of partial vacuum in the crank case the outlet port 65 of this valve is closed, and therefore neither lubricant nor air will be returned from the gear case to the crank case. But at these times the ports 48 and 91 will be successively opened for brief periods to draw lubricant from the valve assembly and separating chambers.

In the operation of a motorcycle embodying my invention I am able to constantly deliver to the bearings a supply of lubricant several times greater than has heretofore been thought practical, with no excessive accumulation in the crank and gear chambers, and no external distribution, waste, or drip. Due to the constant circulation of this large supply of lubricant the bearings are kept cool and in substantially perfect working condition. The reservoir may serve as a heat radiator and may be large enough to allow the recirculated lubricant to be cooled and mixed with the supply before it is returned to the engine bearings.

While there has been shown and described a particular embodiment of the invention, it will be obvious to those skilled in the art that changes and modifications may be made without departing from the invention, and therefore, it is intended by the appended claims to cover all such changes and modifications as falls within the true spirit and scope of the invention.

I claim:

1. An adjustable lubricating system for an internal combustion engine comprising an oil pump connected to said engine with a pressure relief valve connected thereto, said pressure relief valve being connected to a plurality of engine oil passages adjacent the pump outlet through which pressurized oil flows to lubricate various engine parts depending upon the positioning of the plunger of said valve, said pressure relief valve having a valve bore and a plunger therein, said valve bore having internal threads adjacent its exterior end, a pressure relief valve cap having a bore extending therethrough, said bore having threads therein, an adjusting screw positioned in said bore, said screw having a threaded shank engaging the threads of said cap bore and being threadedly movable therein, said cap having threads thereon externally thereof, said external threads engaging said internal threads of said valve bore of said pressure relief valve thereby connecting said pressure relief valve cap to said pressure relief valve of said oil pump of said engine, an oil seal secured to said cap adjacent to said bore threads, said seal engaging said screw, a pressure relief spring positioned in said valve bore between said cap and said pressure relief valve plunger, said screw engaging said spring of said pressure relief valve, said pressure relief spring engaging said plunger, said plunger being movable against said spring to open and block a plurality of engine part lubrication oil passages and a bypass oil passage in response to the outlet pressure of said pump, whereby the distribution of oil to the engine parts being lubricated is determined by adjusting the position of said screw in said cap bore.

2. The lubricating system of claim 1 wherein said cap has an aperture therein communicating with said valve bore, said aperture providing communication between said valve bore and one of said parts to be lubricated.

3. The lubricating system of claim 2 wherein said cap bore is larger than said screw between said aperture and said valve bore.

4. The lubricating system of claim 2 wherein said aperture is between said oil seal and said valve bore.

5. The lubricating system of claim 2 wherein said cap has an elongated slot therein extending from said cap bore radially outwardly thereof, said slot extending axially from between said aperture and said valve bore.

6. The lubricating system of claim 1 wherein said oil seal is chosen from the group consisting of single and double lipped oil seals.

7. The lubricating system of claim 6 wherein said oil seal further comprises an oil ring seal positioned in said cap bore adjacent to said oil seal, said oil ring seal being between said oil seal and said valve bore.

8. The lubricating system of claim 1 further comprising an oil pressure gauge, said oil pressure gauge being connected to the outlet of said oil pump downstream of said pressure relief valve, said screw being positioned in said cap bore in accordance with the reading of said oil pressure gauge.

9. The lubricating system of claim 1 wherein said oil pump is the stock aluminum bodied rotary gear oil pump for the 74 and 80 cubic inch twin-v Harley-Davidson motorcycle engine.

10. The lubricating system of claim 1 wherein said external threads are right handed and 20 threads per inch.

11. The lubricating system of claim 2 wherein said aperture is generally centered in said shank, said aperture having a diameter of about 0.125 plus or minus 0.005 inches.

12. The lubricating system of claim 5 wherein said slot has a depth of about 0.035 inches plus or minus 0.005 inches.

13. The lubricating system of claim 2 wherein said aperture provides pressurized oil to a chain chosen from the group of chains consisting of primary and secondary chains and combinations thereof on a Harley-Davidson motorcycle equipped with an engine chosen from the group consisting of 74 and 80 cubic inch twin-v Harley-Davidson engines having stock aluminum bodied, rotary gear, oil pumps.

14. The lubricating system of claim 1 wherein said cap exterior is in part hexagonal.

15. The lubricating system of claim 1 wherein said valve cap bore is step diametered, the larger portion thereof having no threads, the smaller portion thereof having threads, the larger and unthreaded portion being between said smaller portion and said valve bore, said oil seal being in said smaller and threaded portion.

16. The lubricating system of claim 15 wherein said threaded portion and said screw have 24 threads per inch.

17. The lubricating system of claim 16 wherein said screw threads are right handed whereby turning said screw clockwise will increase the oil pressure and move the valve plunger toward said cap and turning said screw counter-clockwise will decrease the oil pressure and move the valve plunger away from said cap.

18. The lubricating system of claim 1 wherein said cap is made of aluminum and said screw is made of steel.

* * * * *